US009650757B2

(12) United States Patent
Tanaka

(10) Patent No.: US 9,650,757 B2
(45) Date of Patent: May 16, 2017

(54) CONSTRUCTION MACHINE

(71) Applicant: Caterpillar SARL, Geneva (CH)

(72) Inventor: Kimikage Tanaka, Tokyo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/032,417

(22) PCT Filed: Nov. 7, 2014

(86) PCT No.: PCT/EP2014/074075

§ 371 (c)(1),
(2) Date: Apr. 27, 2016

(87) PCT Pub. No.: WO2015/071194

PCT Pub. Date: May 21, 2015

(65) Prior Publication Data

US 2016/0265190 A1 Sep. 15, 2016

(30) Foreign Application Priority Data

Nov. 12, 2013 (JP) ..... 2013-234221

(51) Int. Cl.

| | |
|---|---|
| ***E02F 9/22*** | (2006.01) |
| ***E02F 9/08*** | (2006.01) |
| *E02F 3/32* | (2006.01) |
| *E02F 9/16* | (2006.01) |

(52) U.S. Cl.

CPC ..... *E02F 9/0808* (2013.01); *E02F 9/0866* (2013.01); *E02F 3/32* (2013.01); *E02F 9/163* (2013.01); *E02F 9/22* (2013.01)

(58) Field of Classification Search

CPC ..... E02F 9/0808; E02F 9/0866

See application file for complete search history.

(56) References Cited

U.S. PATENT DOCUMENTS

| | | | |
|---|---|---|---|
| 6,453,522 | B1 | 9/2002 | Romero Magarino et al. |
| 6,510,662 | B2 | 1/2003 | Ichimaru |
| 8,267,217 | B2 | 9/2012 | Kotani et al. |
| 8,820,821 | B2 | 9/2014 | Ushiroguchi |

(Continued)

FOREIGN PATENT DOCUMENTS

| | | |
|---|---|---|
| EP | 1176259 | 1/2002 |
| EP | 2302140 | 3/2011 |
| EP | 2581505 | 4/2013 |

(Continued)

OTHER PUBLICATIONS

International Search Report dated Jan. 14, 2015.

*Primary Examiner* — John Walters
*Assistant Examiner* — James Triggs

(57) ABSTRACT

A construction machine includes a substantially vertical firewall located in front of an engine, which is mounted to a main swing frame of the machine. The firewall may include a plurality of partition plates, and a plurality of elastically deformable protruding plates connected along lower ends of the partition plates. A lateral plate connected to a bottom plate of the swing frame may be fitted between the elastically deformable protruding plates and the lower ends of the partition plates to fix the lower ends of the partition plates to the main swing frame of the machine. The lateral plate may be located in front of a lower part of the engine.

19 Claims, 7 Drawing Sheets

(56) References Cited

U.S. PATENT DOCUMENTS

| | | | | |
|---|---|---|---|---|
| 2014/0020972 | A1* | 1/2014 | Masumoto ..... | B60K 11/06<br>180/309 |

FOREIGN PATENT DOCUMENTS

| | | | |
|---|---|---|---|
| JP | 55-119258 | A | 9/1980 |
| JP | 02-182586 | A | 7/1990 |
| JP | 05-310084 | A | 11/1993 |
| JP | 06-227432 | A | 8/1994 |
| JP | 2004-278682 | A | 10/2004 |
| JP | 2006-076400 | A | 3/2006 |
| JP | 2012-57590 | | 3/2012 |
| JP | 2013-042601 | A | 2/2013 |
| WO | WO2015071194 | | 5/2015 |

* cited by examiner

CONSTRUCTION MACHINE

CLAIM FOR PRIORITY

This application is a U.S. National Phase entry under 35 U.S.C. §371 from PCT International Application No. PCT/EP2014/074075, filed Nov. 7, 2014, which claims benefit of priority of Japanese Patent Application No. JP 2013-234221, filed Nov. 12, 2013, all of which are incorporated herein by reference.

TECHNICAL FIELD

The present invention relates to a construction machine including a frame forming a frame structure, an engine mounted on the frame, and a partition wall covering a front side of the engine.

BACKGROUND ART

Generally, a hydraulic shovel, which is a typical example of a construction machine, mainly includes a movable lower traveling body, an upper swinging body rotatably mounted on the lower traveling body, and a working arm apparatus attached to the upper swinging body in a vertically movable manner. In an operation of excavating soil and the like, the working arm apparatus is operated to vertically move, and the upper swinging body swings with respect to the lower traveling body.

The working arm apparatus mainly includes a boom attached to a front portion of the upper swinging body in a vertically movable manner, an arm that is rotatably attached to a front portion of the boom, an operating tool rotatably attached to a lower portion of the arm, a boom cylinder that rotates the boom, an arm cylinder that rotates the arm, and an operation tool cylinder that rotates the operation tool.

The upper swinging body includes a swing frame forming the frame structure thereof, an engine mounted on the swing frame, a hydraulic device disposed on a front side of the engine, and the like. The hydraulic device disposed on the front side of the engine includes a swing motor that makes the upper swinging body swing with respect to the lower traveling body, a control valve that controls supplying/discharging of pressure oil from a hydraulic pump, which is a pressure oil supply source, to a hydraulic actuator such as the boom cylinder, and the like.

A partition wall extending in a left and right direction is disposed between the engine and the hydraulic device. The partition wall covers a front side of the engine to block heat and sound produced by the engine being driven. A supporting frame is disposed on an upper side of the partition wall. The supporting frame is formed of an angle steel and the like and extends across the swing frame in the left and right direction. The partition wall is fixed to the swing frame with the upper end side thereof attached to the supporting frame with a bolt (see, for example, Patent Document 1).

[Patent Document 1] Japanese Patent Application Laid-open No. 2012-57590

The conventional construction machine described above has the following problem to be solved.

Generally, when the upper swinging body is assembled, the engine and the hydraulic device are mounted on the swing frame before the partition wall is attached to the swing frame. Thus, when the partition wall is attached to the swing frame, the engine and the hydraulic device are already mounted on the swing frame. As a result, an operation space, required for an assembly worker to attach a lower end side of the partition wall to the swing frame with a bolt, is small. All things considered, there is a problem that it is difficult to attach the lower end side of the partition wall to the swing frame.

Due to this problem, in some cases, only the upper end side of the partition wall is fixed to the swing frame without the lower end side of the partition wall being fixed to the swing frame. In such a case, a seal member, formed of a resin material, may be disposed between the lower end side of the partition wall and the swing frame, to fill a gap between the lower end side of the partition wall and the swing frame. However, the lower end side of the partition wall is not fixed to the swing frame and thus rattles with respect to the swing frame when the vehicle performs a traveling operation or an operation such as excavating. Thus, there is a problem that a gap is produced between the lower end side of the partition wall and the swing frame, thereby degrading a blocking function of the partition wall.

DISCLOSURE OF THE INVENTION

The present invention is made in view of the above described situation, and a main technical object of the present invention is to provide a construction machine having the following feature. Specifically, even when an operation space, required for an assembly operator to attach a lower end side of a partition wall to a frame with a bolt and the like, is small due to an engine and an hydraulic device mounted on a frame, the lower end side of the partition wall can be easily and surely fixed on the frame. As a result, a blocking function of the partition wall can be prevented from degrading.

The present invention provides, as a construction machine that achieves the above described technical object, a construction machine including: a frame forming a frame structure; an engine mounted on the frame; and a partition wall that covers a front side of the engine. The frame includes: a bottom plate; and a lateral plate that is positioned at a front lower side of the engine, extends in a left and right direction, and stands on the bottom plate. The partition wall includes: a partition plate that is positioned on an upper side of the lateral plate and extends in the left and right direction; and a protruding plate that protrudes forward from a lower end side of the partition plate and then extends downward. The lateral plate is fit between the partition plate and the protruding plate so that a lower end side of the partition wall is fixed to the frame.

Preferably, the protruding plate includes: an attached portion that extends in the left and right direction and is attached to a front surface of the partition plate on the lower end side; a protruding portion protruding forward from a lower end of the attached portion; a first inclined portion extending obliquely backward and downward from a front end of the protruding portion; and a second inclined portion extending obliquely forward and downward from a lower end of the first inclined portion. Preferably, the first inclined portion is curved to protrude forward as viewed in the left and right direction. Preferably, an opening is formed in the protruding plate. Preferably, the opening has a substantially triangular shape. Preferably, the opening is formed over the protruding portion and the first inclined portion.

In the construction machine of the present invention, the lateral plate is fit between the partition plate and the protruding plate so that the lower end side of the partition wall is fixed to the frame. Thus, even when an operation space, required for attaching the lower end side of the partition wall to the frame with a bolt and the like, is small due to an engine and a hydraulic device mounted on the frame, an assembly operator can easily and surely fix the lower end side of the partition wall on the frame through the following operation. Specifically, the partition wall is lowered from the upper side of the frame and the lateral plate is fit between the partition plate and the protruding plate.

In the construction machine of the present invention, the lateral plate is fit between the partition plate and the protruding plate so that the lower end side of the partition wall is fixed to the frame. Thus, the lower end side of the partition wall moves in accordance with the frame without vibrating with respect to the frame even when a vehicle body performs a traveling operation or an operation such as excavating. Thus, no gap is formed between the lower end side of the partition wall and the frame. As a result, a blocking function of the partition wall can be prevented from degrading.

BEST MODE FOR CARRYING OUT THE INVENTION

A construction machine having a configuration according to the present invention is described by referring to an embodiment of a hydraulic shovel as a typical construction machine shown in FIGS. 1 to 8.

Figure 1:
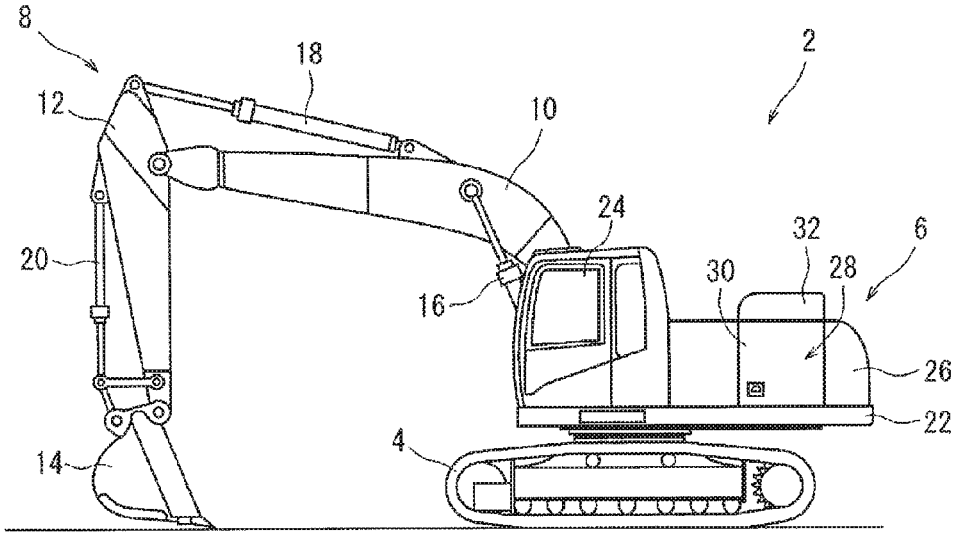
FIG. 1 is a left side view of a hydraulic shovel, as a typical construction machine, having a configuration according to the present invention.

A description is given by referring to FIG. 1. A hydraulic shovel having the entire structure denoted by the numeral 2 mainly includes a movable lower traveling body 4, an upper swinging body 6 mounted on the lower traveling body 4 in such a manner as to be capable of swinging, and a working arm apparatus 8 attached to the upper swinging body 6 in a vertically movable manner. In an operation of excavating soil and the like, the working arm apparatus 8 is operated to be vertically moved, and the upper swinging body 6 swings with respect to the lower traveling body 4.

The working arm apparatus 8 mainly includes a boom 10 attached to a front portion of the upper swinging body 6 in a vertically movable manner, an arm 12 pivotally attached to a front portion of the boom 10, an operating tool 14 pivotally attached to a lower portion of the arm 12, a pair of left and right boom cylinders 16 that are respectively attached to left and right sides of the boom 10 and vertically move the boom 10, an arm cylinder 18 that is disposed at an upper portion of the boom 10 and pivotally moves the arm 12, and a cylinder 20 that is disposed on a front portion of the arm 12 and pivotally moves the operating tool 14.

The upper swinging body 6 includes a swing frame 22 as a frame structure thereof, an operation room 24 where an operator gets in, disposed at a left front portion on the swing frame 22, a counter weight 26 disposed at a rear portion on the swing frame 22, a device containing chamber 28 that is disposed on a front side of the counter weight 26 and contains devices such as an engine, a door 30 that is attached to the swing frame 22 in an openable manner and covers a side portion of the device containing chamber 28, a hood 32 that is attached to the swing frame 22 in an openable manner and covers an upper side of the device containing chamber 28, and the like.

Figure 2:
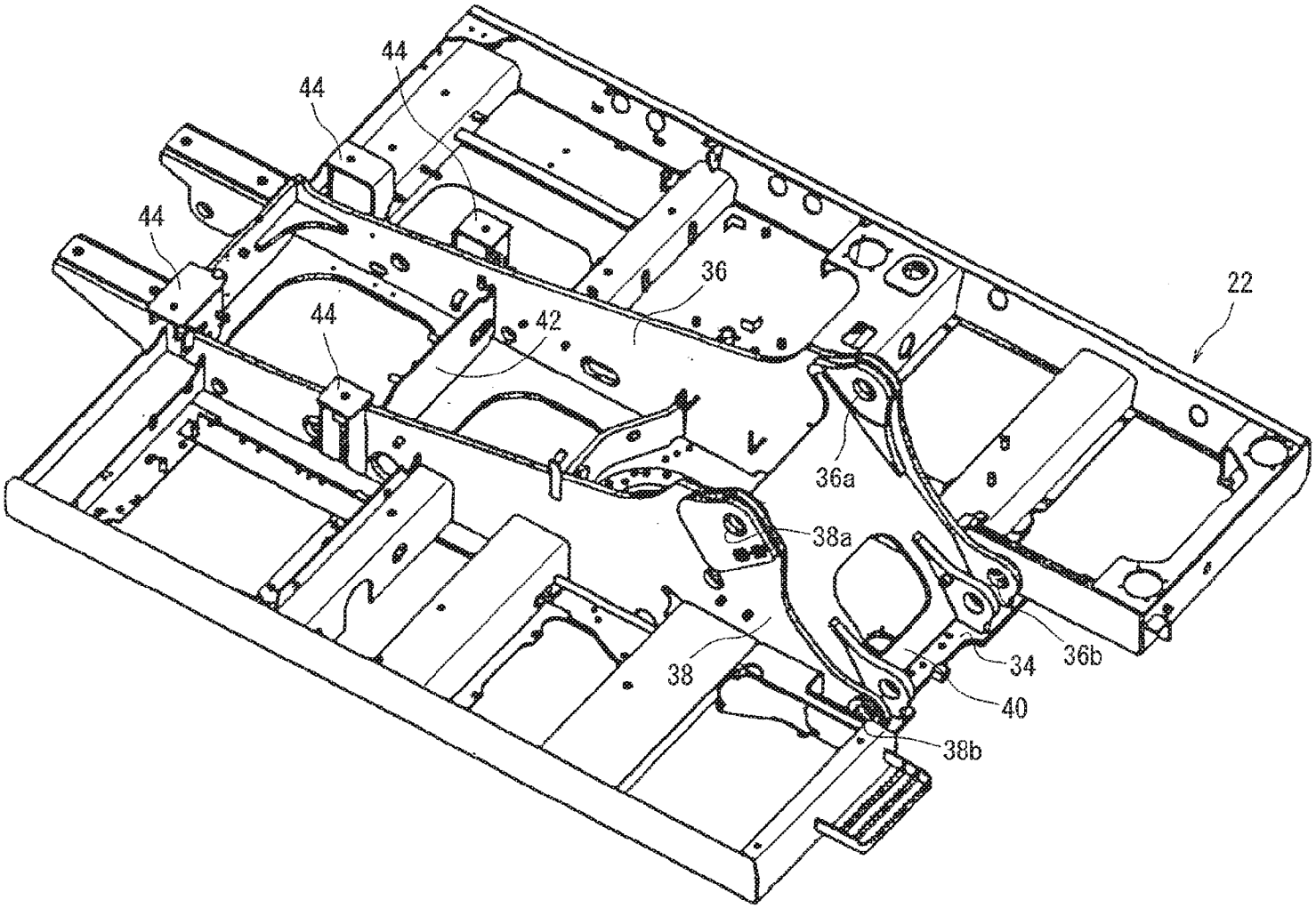
FIG. 2 is a perspective view of a swing frame shown in FIG. 1.

A description is given by referring to FIG. 2. The swing frame 22 includes a bottom plate 34 and a pair of left and right vertical plates 36 and 38 extending in a front and rear direction and standing on the bottom plate 34. Each of the vertical plates 36 and 38 has a substantially triangular shape, and is welded to the bottom plate 34. Boom brackets 36*a* and 38*a*, to which the boom 10 is coupled through coupling pins, are respectively formed on upper ends of the vertical plates 36 and 38. Boom cylinder brackets 36*b* and 38*b*, to which the boom cylinders 16 are coupled through coupling pins, are respectively formed on front ends of the vertical plates 36 and 38.

An inclined plate 40 obliquely extending along outer edges of the vertical plates 36 and 38 is formed at a front portion between the vertical plates 36 and 38. A lateral plate 42 extending in a left and right direction stands on the bottom plate 34 at a portion slightly more on the rear side than center portion between the vertical plates 36 and 38. The inclined plate 40 and the lateral plate 42 are welded on the vertical plates 36 and 38 and the bottom plate 34. Engine mounts 44 are disposed along the vertical plates 36 and 38 at a portion behind the lateral plate 42. The engine mounts 44 are disposed at two portions on each of the vertical plates 36 and 38 and thus are disposed at total of four portions.

Figure 3:
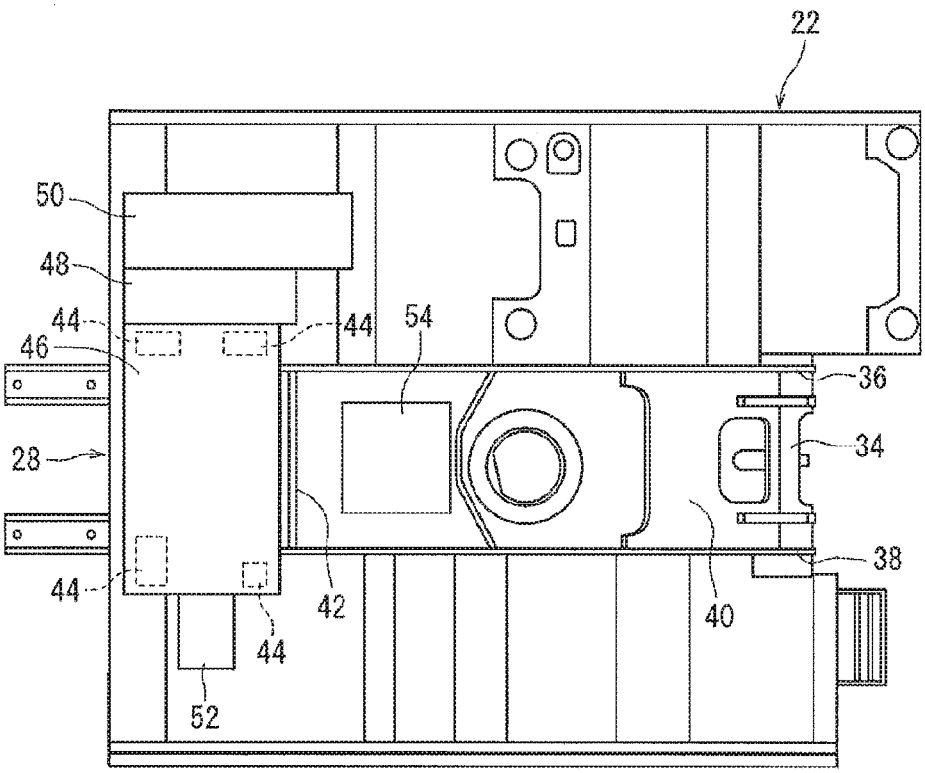
FIG. 3 is an upper view of a device mounted on the swing frame shown in FIG. 2.

The devices contained in the device containing chamber 28 are described by referring to FIG. 3. An engine 46 is mounted on the engine mounts 44 of the swing frame 22. A cooling fan 48, connected to a distal end of a left side output shaft of the engine 46, is disposed on the left side of the engine 46. A cooling package 50 is disposed more on the left side than the cooling fan 48. The cooling package 50 is an integral package including a plurality of heat exchangers such as a radiator, an oil cooler, and an intercooler. A hydraulic pump 52, as a pressure oil supply source connected to a distal end of a right side output shaft of the engine 46, is disposed on the right side of the engine 46.

A control valve 54 that controls supplying/discharging of pressure oil from the hydraulic pump 52 to the hydraulic actuator such as the boom cylinder 16, is disposed outside of the device containing chamber 28 and on the front side of the engine 46.

Figure 4:
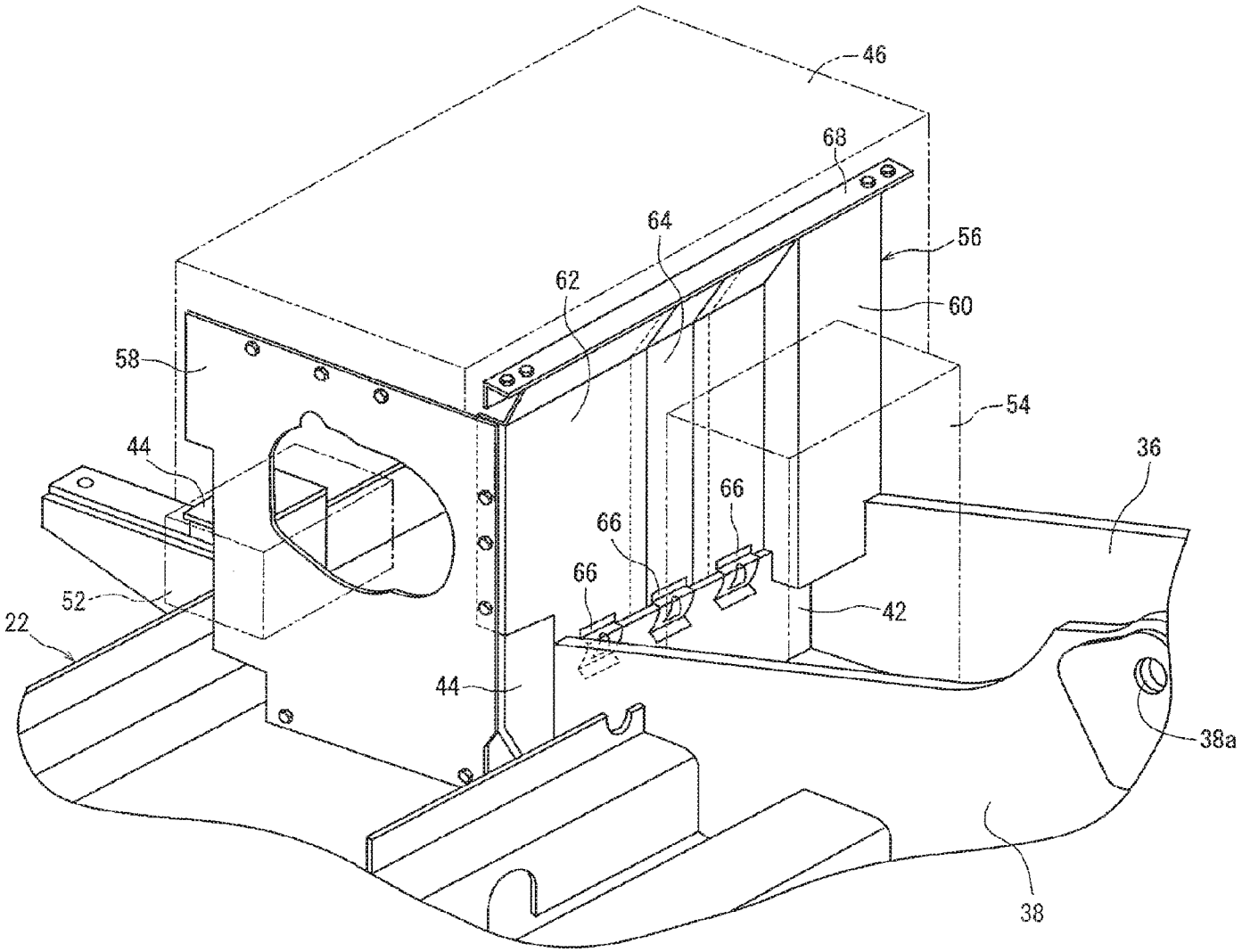
FIG. 4 is a front perspective view of a lateral partition wall and the like attached to the swing frame shown in FIG. 2.
Figure 5:
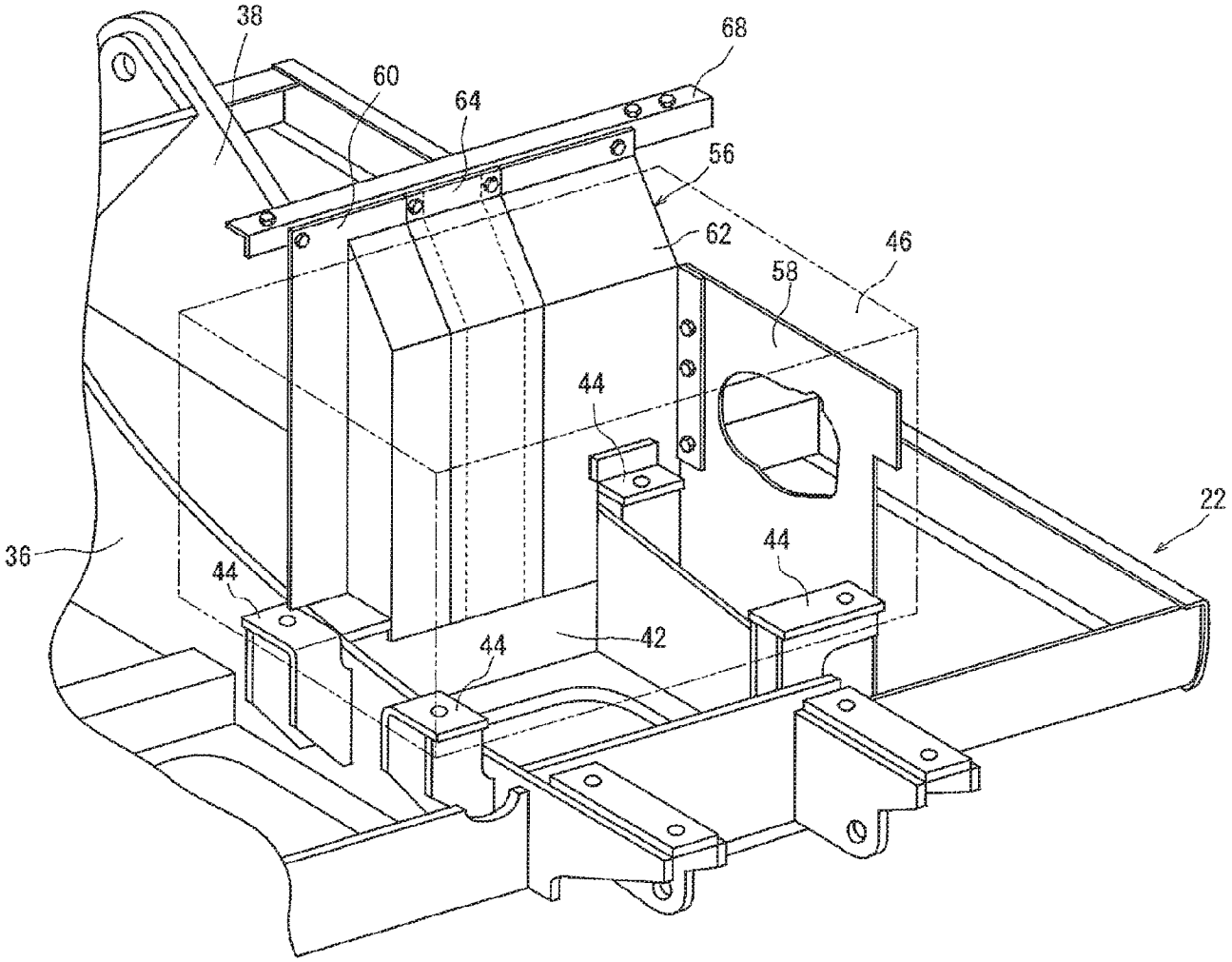
FIG. 5 is rear perspective view of the lateral partition wall and the like attached to the swing frame shown in FIG. 2.
Figure 6:
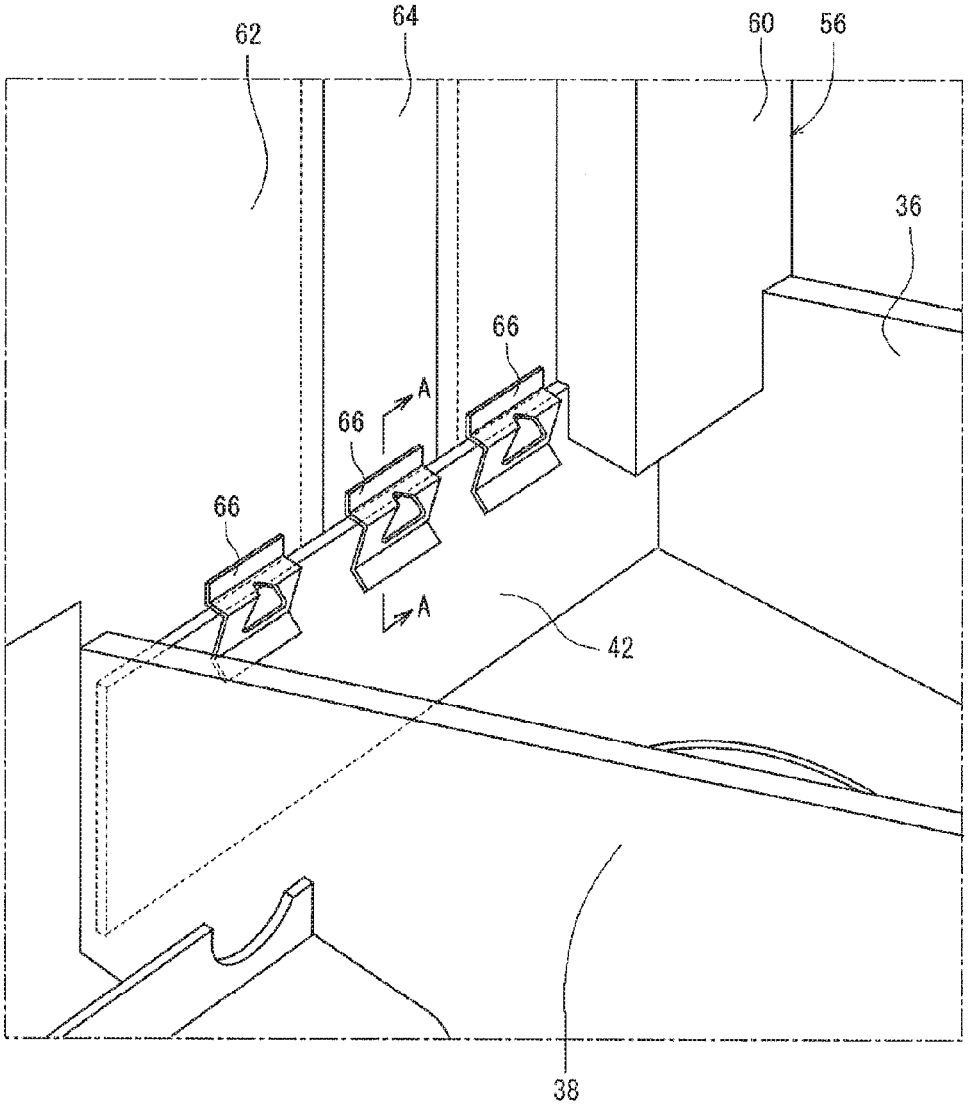
FIG. 6 is an enlarged view of a lower end side of the lateral partition wall shown in FIG. 4.

A description is given by referring to FIGS. 4 to 6. A lateral partition wall 56 is disposed between the engine 46 and the control valve 54 and on the upper side of the lateral plate 42. The lateral partition wall 56 covers the front side of the engine 46 to block heat and sound produced by the driving engine 46. A vertical partition wall 58 is connected to a right end portion of the lateral partition wall 56. The vertical partition wall 58 extends in the front and rear direction and separates the engine 46 from the hydraulic pump 52.

The lateral partition wall 56 includes a left lateral partition plate 60 positioned on a side of the left vertical plate 36, a right lateral partition plate 62 positioned on a side of the right vertical plate 38, an intermediate lateral partition plate 64 positioned between the left lateral partition plate 60 and the right lateral partition plate 62, and protruding plates 66 respectively attached to front surfaces of the lateral partition plates 60, 62, and 64 on the lower end side.

The lateral partition plates 60, 62, and 64 extend in the left and right direction while vertically standing along an upper rear surface of the lateral plate 42. A right end rear surface of the left lateral partition plate 60 is laid on a left end front surface of the intermediate lateral partition plate 64, whereas a right end front surface of the intermediate lateral partition plate 64 is laid on a left end rear surface of the right lateral partition plate 62. A seal member (not illustrated), formed of a resin material, is disposed therebetween to fill a gap.

Figure 7:
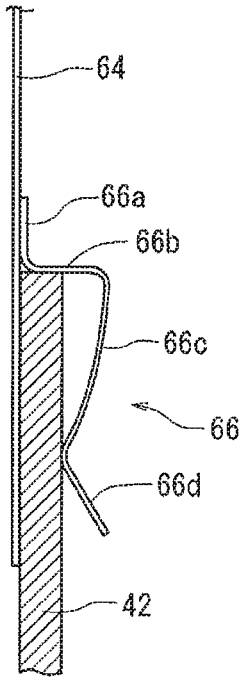
FIG. 7 is a cross-sectional view as viewed in the direction A-A in FIG. 6.
Figure 8:
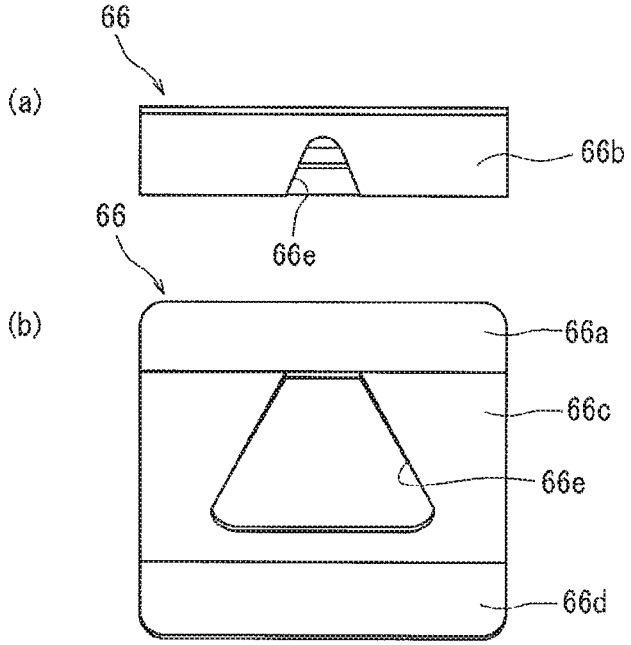
FIGS. 8(*a*) and 8(*b*) are respectively upper and front views of a protruding plate.

A description is given by referring to FIGS. 7 and 8. The protruding plate 66 is formed by bending a rectangular plate material. The protruding plate 66 includes an attached portion 66*a* that extends in the left and right direction in a vertically standing state and welded to a front surface of each of the lateral partition plates 60, 62, and 64 on the lower end side, a protruding portion 66*b* extending forward substantially horizontally from the lower end of the attached portion 66*a*, a first inclined portion 66*c* extending obliquely backward and downward from the front end of the protruding portion 66*b*, and a second inclined portion 66*d* extending obliquely forward and downward from the lower end of the first inclined portion 66*c*. The first inclined portion 66*c* is curved to protrude forward as viewed in the left and right direction.

The protruding plate 66, which is attached on the front surface of each of the lateral partition plates 60, 62, and 64 on the lower end side in this embodiment, may be attached to a rear surface of each of the lateral partition plates 60, 62, and 64 on the lower end side. The protruding plate 66 in this configuration, and that in the configuration of being disposed on the front surface of each of the lateral partition plates 60, 62, and 64 in the lower end side, are symmetrical with respect to each of the lateral partition plates 60, 62, and 64. Specifically, the attached portion 66*a* is welded to the rear surface of each of the lateral partition plates 60, 62, and 64 on the lower end side. The protruding portion 66*b* extends substantially horizontally toward the rear from the lower end of the attached portion 66*a*. The first inclined portion 66*c* extends obliquely forward and downward from the rear end of the protruding portion 66*b*. The second inclined portion 66*d* extends obliquely backward and downward from the lower end of the first inclined portion 66*c*. In this configuration, the first inclined portion 66*c* is curved to protrude backward as viewed in the left and right direction. Each of the lateral partition plates 60, 62, and 64 extends in the left and right direction along the upper front surface of the lateral plate 42.

As shown in FIG. 8, a substantially triangular opening 66*e*, formed over the protruding portion 66*b* and the first inclined portion 66*c*, is formed in the protruding plate 66. Thus, the width in the left and right direction of the protruding portion 66*b* gradually decreases from a portion slightly on the front side than the rear end toward the front to the front end. The width in the left and right direction of the first inclined portion 66*c* decreases from the upper end toward the lower side to a portion slightly above the lower end.

A supporting frame 68 (see FIGS. 4 and 5), formed of an angle steel, is disposed on the upper portion of the lateral partition wall 56, and extends across the swing frame 22 in the left and right direction. The upper end sides of the lateral partition plates 60, 62, and 64 are attached to the supporting frame 68 with bolts so that an upper end side of the lateral partition wall 56 is fixed to the swing frame 22. Moreover, the lateral plate 42 is fit between the lateral partition plates 60, 62, and 64 and the protruding plates 66 so that the lower end side of the lateral partition wall 56 is fixed to the swing frame 22.

Effects of the above-described construction machine shown in FIGS. 1 to 8 will be described.

In the construction machine of the present invention, the lateral plate 42 is fit between the lateral partition plates 60, 62, and 64 and the protruding plates 66 so that the lower end side of the lateral partition wall 56 is fixed to the swing frame 22. Thus, even when an operation space, required for attaching the lower end side of the lateral partition wall 56 to the swing frame 22 with a bolt and the like, is small due to the engine 46 and the control valve 54 mounted on the swing frame 22, an assembly operator can easily and surely fix the lower end side of the lateral partition wall 56 on the swing frame 22 through the following operation. Specifically, the lateral partition wall 56 is lowered from the upper side of the swing frame 22 and the lateral plate 42 is fit between the lateral partition plates 60, 62, and 64 and the protruding plates 66.

In the construction machine of the present invention, the lateral plate 42 is fit between the lateral partition plates 60, 62, and 64 and the protruding plates 66 so that the lower end side of the lateral partition wall 56 is fixed to the swing frame 22. Thus, the lower end side of the lateral partition wall 56 moves in accordance with the swing frame 22 without vibrating with respect to the swing frame 22 even when the vehicle performs a traveling operation or an operation such as excavating. Thus, no gap is formed between the lower end side of the lateral partition wall 56 and the lateral plate 42 of the swing frame 22. As a result, a blocking function of the lateral partition wall 56 can be prevented from degrading.

The protruding plate 66 includes the attached portion 66*a* that extends in the left and right direction and is attached on the front surface of each of the lateral partition plates 60, 62, and 64 on the lower end side, the protruding portion 66*b* extending forward substantially horizontally from the lower end of the attached portion 66*a*, the first inclined portion 66*c* that extends obliquely backward and downward from the front end of the protruding portion 66*b* and is curved to protrude forward as viewed in the left and right direction, and the second inclined portion 66*d* extending obliquely forward and downward from the lower end of the first inclined portion 66*c*. Thus, the protruding plate 66 elastically deforms when the lateral plate 42 fits between the lateral partition plates 60, 62, and 64 and the protruding plates 66, whereby the first and the second inclined portions 66*c* and 66*d* hold the lateral plate 42 at the front surface. As a result, the lower end side of the lateral partition wall 56 is more easily and surely fixed to the swing frame 22. Furthermore, the same protruding plate 66 can be used for models with different lateral plate thicknesses. Thus, an attempt to share the common protruding plate 66 among a plurality of models can be facilitated.

The substantially triangular opening 66*e* is formed over the protruding portion 66*b* and the first inclined portion 66*c* of the protruding plate 66. Thus, the stress on the elastically deformed protruding plate 66 is dispersed. Thus, the protruding plate 66 can be used for thicker lateral plate, compared with the case where the opening 66*e* is not formed. As a result, the same protruding plate 66 can be used for a wider range of thicknesses. Thus, the attempt to share the same component can be further facilitated.

EXPLANATION OF REFERENCE NUMERALS

22 swing frame
34 bottom plate

42 lateral plate
46 engine
56 lateral partition wall
60 left lateral partition wall
62 right lateral partition wall
64 intermediate lateral partition wall
66 protruding plate
66*a* attached portion
66*b* protruding portion
66*c* first inclined portion
66*d* second inclined portion
66*e* opening

The invention claimed is:

1. A construction machine comprising: a frame forming a frame structure; an engine mounted on the frame; and a partition wall that covers a front side of the engine, wherein the frame includes: a bottom plate; a pair of left and right vertical plates extending in a front and rear direction and standing on the bottom plate; and a lateral plate that is positioned at a front lower side of the engine, extends in a left and right direction orthogonal to the front and rear direction of the left and right vertical plates, and is joined at opposite ends to the left and right vertical plates, and stands on and is joined to the bottom plate, the partition wall includes: a partition plate separate from the lateral plate, wherein the partition plate is positioned on an upper side of the lateral plate and extends in the left and right direction; and a protruding plate that is attached to a lower end side of the partition plate and protrudes forward from the lower end side of the partition plate and then extends downward, and the lateral plate is fit between the partition plate and the protruding plate so that a lower end side of the partition wall is fixed to the frame.

2. The construction machine according to claim 1, wherein the protruding plate includes: an attached portion that extends in the left and right direction and is attached to a front surface of the partition plate on the lower end side; a protruding portion protruding forward from a lower end of the attached portion; a first inclined portion extending obliquely backward and downward from a front end of the protruding portion; and a second inclined portion extending obliquely forward and downward from a lower end of the first inclined portion.

3. The construction machine according to claim 2, wherein the first inclined portion is curved to protrude forward as viewed in the left and right direction.

4. The construction machine according to claim 2, wherein an opening is formed in the protruding plate.

5. The construction machine according to claim 4, wherein the opening has a substantially triangular shape.

6. The construction machine according to claim 4, wherein the opening is formed over the protruding portion and the first inclined portion.

7. The construction machine according to claim 1, wherein each of the vertical plates has a substantially triangular shape, and is welded to the bottom plate.

8. The construction machine according to claim 7, wherein the lateral plate is welded to the vertical plates and the bottom plate.

9. A swing frame for a machine, the swing frame supporting components of the machine including an engine, an operator cab, a cooling fan, a heat exchanger, a hydraulic pump, boom brackets, and boom cylinder brackets, the swing frame comprising:

a bottom plate;

a pair of left and right vertical plates extending in a front and rear direction and being connected to the bottom plate, the boom brackets and boom cylinder brackets being formed on the left and right vertical plates;

a lateral plate extending in a left and right direction between the left and right vertical plates and being connected to the bottom plate and the left and right vertical plates;

engine mounts for supporting the engine being disposed along the left and right vertical plates at a portion of the left and right vertical plates behind the lateral plate; and a lateral partition wall disposed in a left and right direction in front of the engine and separating the engine from the hydraulic pump, the lateral partition wall being connected along a lower end side to an upper surface of the lateral plate.

10. The swing frame according to claim 9, wherein:

the lateral partition wall includes at least one partition plate extending in a left and right direction; and a protruding plate being attached to each of the at least one partition plate along one of a front surface or a rear surface of a lower end side of each partition plate, the protruding plate extending downward toward the lateral plate; and the lateral plate being fitted between each of the at least one partition plate and the protruding plate so that the lower end side of the partition wall is fixed to the frame.

11. The swing frame according to claim 10, wherein each protruding plate includes: an attached portion that extends in the left and right direction and is attached to a front surface of one of the at least one partition plate on the lower end side; a protruding portion protruding forward from a lower end of the attached portion; a first inclined portion extending obliquely backward and downward from a front end of the protruding portion; and a second inclined portion extending obliquely forward and downward from a lower end of the first inclined portion.

12. The swing frame according to claim 10, wherein each protruding plate includes: an attached portion that extends in the left and right direction and is attached to a rear surface of one of the at least one partition plate on the lower end side; a protruding portion protruding rearward from a lower end of the attached portion; a first inclined portion extending obliquely forward and downward from a rear end of the protruding portion; and a second inclined portion extending obliquely backward and downward from a lower end of the first inclined portion.

13. The swing frame according to claim 11, wherein an opening is formed in the protruding plate.

14. The swing frame according to claim 13, wherein the opening has a substantially triangular shape.

15. The swing frame according to claim 14, wherein the opening is formed over the protruding portion and the first inclined portion.

16. The swing frame according to claim 12, wherein an opening is formed in the protruding plate.

17. The swing frame according to claim 16, wherein the opening has a substantially triangular shape.

18. The swing frame according to claim 17, wherein the opening is formed over the protruding portion and the first inclined portion.

19. A construction machine comprising:

a frame forming a frame structure;

an engine mounted on the frame; and a partition wall that covers a front side of the engine, wherein the frame includes:

a bottom plate;

a pair of left and right vertical plates extending in a front and rear direction and being connected to the bottom plate; and a lateral plate that is positioned at a front lower side of the engine, extends in a left and right direction, and is connected to the bottom plate; and the partition wall includes:

a partition plate that is positioned on an upper side of the lateral plate and extends in the left and right direction; and an elastically deformable protruding plate that protrudes forward from a lower end side of the partition plate and then extends downward, wherein the lateral plate is fit between the partition plate and the protruding plate so that a lower end side of the partition wall is fixed to the bottom plate of the frame.

* * * * *